US010260188B2

(12) United States Patent
Tarr et al.

(10) Patent No.: US 10,260,188 B2
(45) Date of Patent: Apr. 16, 2019

(54) APPLIANCE USER INTERFACE AND METHOD OF OPERATION

(71) Applicant: Haier US Appliance Solutions, Inc., Wilmington, DE (US)

(72) Inventors: Ronald Scott Tarr, Louisville, KY (US); Jarvis Ward, Louisville, KY (US); Tomas Garces, Louisville, KY (US); William Everette Gardner, Louisville, KY (US); John Donovan Nolan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 364 days.

(21) Appl. No.: 15/212,312

(22) Filed: Jul. 18, 2016

(65) Prior Publication Data

US 2018/0017318 A1 Jan. 18, 2018

(51) Int. Cl.

| | |
|---|---|
| ***F25D 27/00*** | (2006.01) |
| ***F25D 11/00*** | (2006.01) |
| ***F21V 3/02*** | (2006.01) |
| ***F25C 1/14*** | (2018.01) |
| ***H05B 33/08*** | (2006.01) |
| ***F21V 33/00*** | (2006.01) |
| ***D06F 1/00*** | (2006.01) |
| ***H01H 1/00*** | (2006.01) |
| ***F24B 1/00*** | (2006.01) |
| ***F25D 29/00*** | (2006.01) |

(52) U.S. Cl.

CPC ..... *D06F 1/00* (2013.01); *F24B 1/00* (2013.01); *F25D 29/00* (2013.01); *H01H 1/00* (2013.01); *F25C 2400/10* (2013.01); *F25D 2400/361* (2013.01); *F25D 2700/04* (2013.01)

(58) Field of Classification Search

CPC ..... A47L 1/00; D06F 1/00; F24B 1/00; F25C 2400/10; F25D 2400/361; F25D 2700/04; F25D 29/00; H01H 1/00

See application file for complete search history.

(56) References Cited

U.S. PATENT DOCUMENTS 7,926,964 B2 4/2011 Claprood
2007/0152977 A1* 7/2007 Ng ..... G06F 3/03547 345/173

(Continued)

*Primary Examiner* — Afroza Chowdhury
(74) *Attorney, Agent, or Firm* — Dority & Manning, P.A.

(57) ABSTRACT

An appliance and method of operation is provided. The appliance may include an outer casing, a user interface, and a controller. The outer casing may define an enclosed volume. The user interface may be mounted to the outer casing to include a light projector and a translucent diffuser disc. The light projector may be positioned within the enclosed volume and include a plurality of discrete segmented light emitting diodes to each selectively emit one or more discrete light emissions. The translucent diffuser disc may be positioned between the light projector and the outer casing. The diffuser disc may include a continuous outer surface aligned with the light projector to display the one or more discrete light emissions as a visually continuous pattern. The controller may be operably connected with the light projector and configured to determine the visually continuous pattern displayed at the continuous outer surface.

18 Claims, 10 Drawing Sheets

(56) References Cited

U.S. PATENT DOCUMENTS

| | | | | |
|---|---|---|---|---|
| 2007/0152983 | A1* | 7/2007 | McKillop | G06F 3/03547 345/173 |
| 2010/0328626 | A1* | 12/2010 | Miyazaki | H04N 9/3114 353/85 |
| 2011/0141761 | A1* | 6/2011 | Linke | G05G 1/015 362/559 |
| 2011/0148775 | A1* | 6/2011 | Rudolph | F24C 7/086 345/173 |
| 2013/0204406 | A1 | 8/2013 | Andersson et al. | |
| 2013/0220136 | A1* | 8/2013 | De Jong | A47J 27/2105 99/285 |
| 2015/0252978 | A1* | 9/2015 | Ueda | F21K 9/00 353/31 |
| 2015/0315737 | A1* | 11/2015 | Yang | F21V 33/0044 362/23.04 |
| 2016/0095513 | A1* | 4/2016 | Shapiro | A61B 3/032 351/209 |

* cited by examiner

APPLIANCE USER INTERFACE AND METHOD OF OPERATION

FIELD OF THE INVENTION

The present subject matter relates generally to an appliance user interface, and more particularly to a user interface for a stand-alone ice making appliance.

BACKGROUND OF THE INVENTION

Appliances, such as stand-alone ice making appliances, generally include a user interface for initiating operations and/or receiving information about those operations. For instance, an input selector is often provided in the form of a knob or switch that a user may engage to begin or end certain operations. A display may also be provided in the form of one or more visibly-distinct light sources. Some existing systems provide multiple individual light sources. The activation of each light source may indicate another unique operation. The exact indication or meaning of each light source might be printed adjacent to the light source or in a corresponding manual. However, using such systems presents a number of problems. For instance, it may be difficult to interpret or understand the meaning of the individual light sources, especially from a distance. Moreover, if a light source fails to activate, it may be difficult to know if the problem lies with the light source or another portion of the appliance.

Some existing systems have provided multiple light sources that activate or work in tandem to generate a pattern that communicates information to a user. Nonetheless, each individual light source may still be visible and identifiable when activated. The displayed light pattern may lack the visual fluidity to necessary to intuitively convey information regarding the appliance. Moreover, the ability to visually identify each light may reduce the aesthetic appeal of the overall appliance. Although a digital display screen may be provided to increase the visual fluidity of the display, this may greatly increase the cost and complexity of the appliance. Furthermore, such displays must generally be separated from the input selector, further obscuring the feedback and input necessary to engage the user interface and appliance.

Accordingly, an improved appliance and user interface are desired in the art. In particular, a cost-effective appliance and user interface that address the above issues would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, an appliance is provided. The appliance may include an outer casing, a user interface, and a controller. The outer casing may define an enclosed volume. The user interface may be mounted to the outer casing to include a light projector and a translucent diffuser disc. The light projector may be positioned within the enclosed volume and include a plurality of discrete segmented light emitting diodes to each selectively emit one or more discrete light emissions. The translucent diffuser disc may be positioned between the light projector and the outer casing. The diffuser disc may include a continuous outer surface aligned with the light projector to display the one or more discrete light emissions as a visually continuous pattern. The controller may be operably connected with the light projector and configured to determine the visually continuous pattern displayed at the continuous outer surface.

In another aspect of the present disclosure, a method of controlling a user interface for an appliance is provided. The user interface may include a light projector having a plurality of discrete segmented light emitting diodes, as well as a diffuser disc having a continuous outer surface. The diffuser disc may be positioned between the light projector and an outer casing of the appliance. The method may include receiving a first condition signal, and selectively initiating a first visually continuous pattern at the continuous outer surface according to the received condition signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
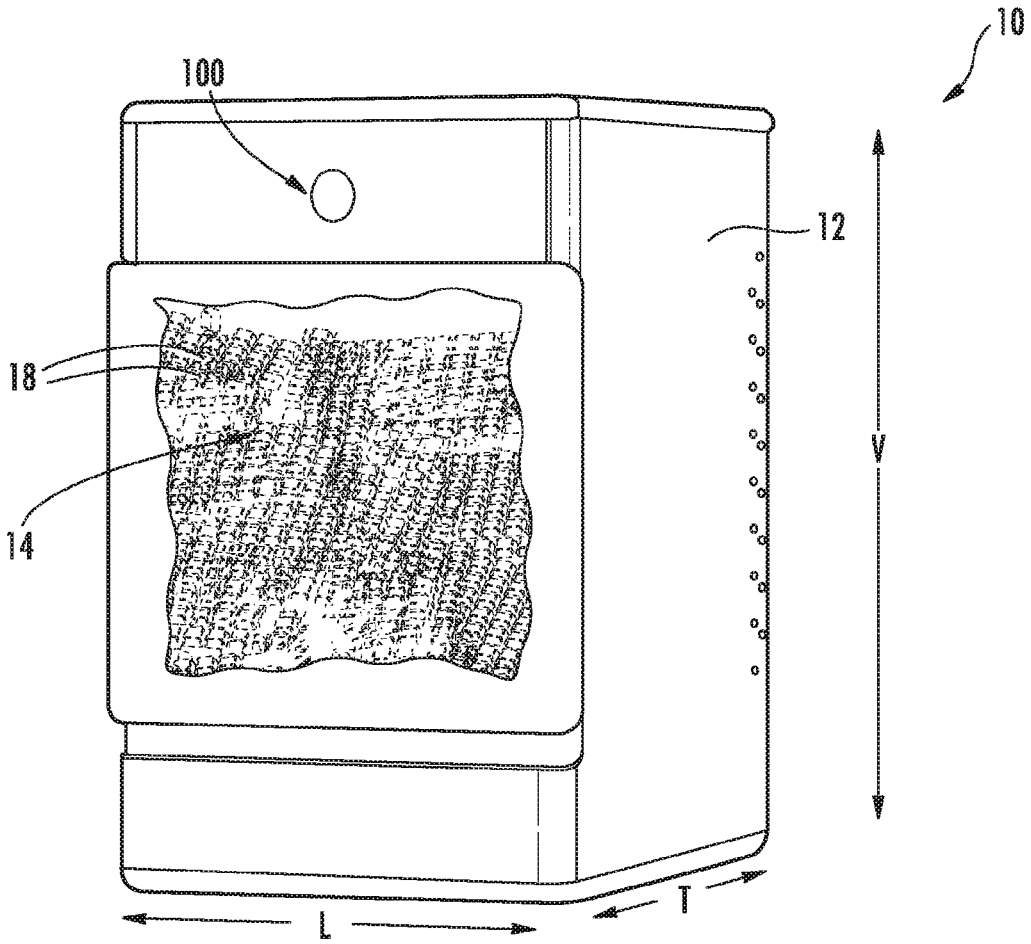
FIG. 1 provides a perspective view of an appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In some aspects of the present disclosure, a user interface is provided for an appliance. The user interface may include multiple light emitting diodes (LEDs) positioned behind a translucent diffuser disc within the appliance. A controller may be provided to control activation of the LEDs. Moreover, the LEDs may be arranged and configured to create a visually continuous pattern when they are activated. During use, the user interface may change between multiple visually continuous patterns, depending on the current state or chosen operation of the appliance.

Figure 2:
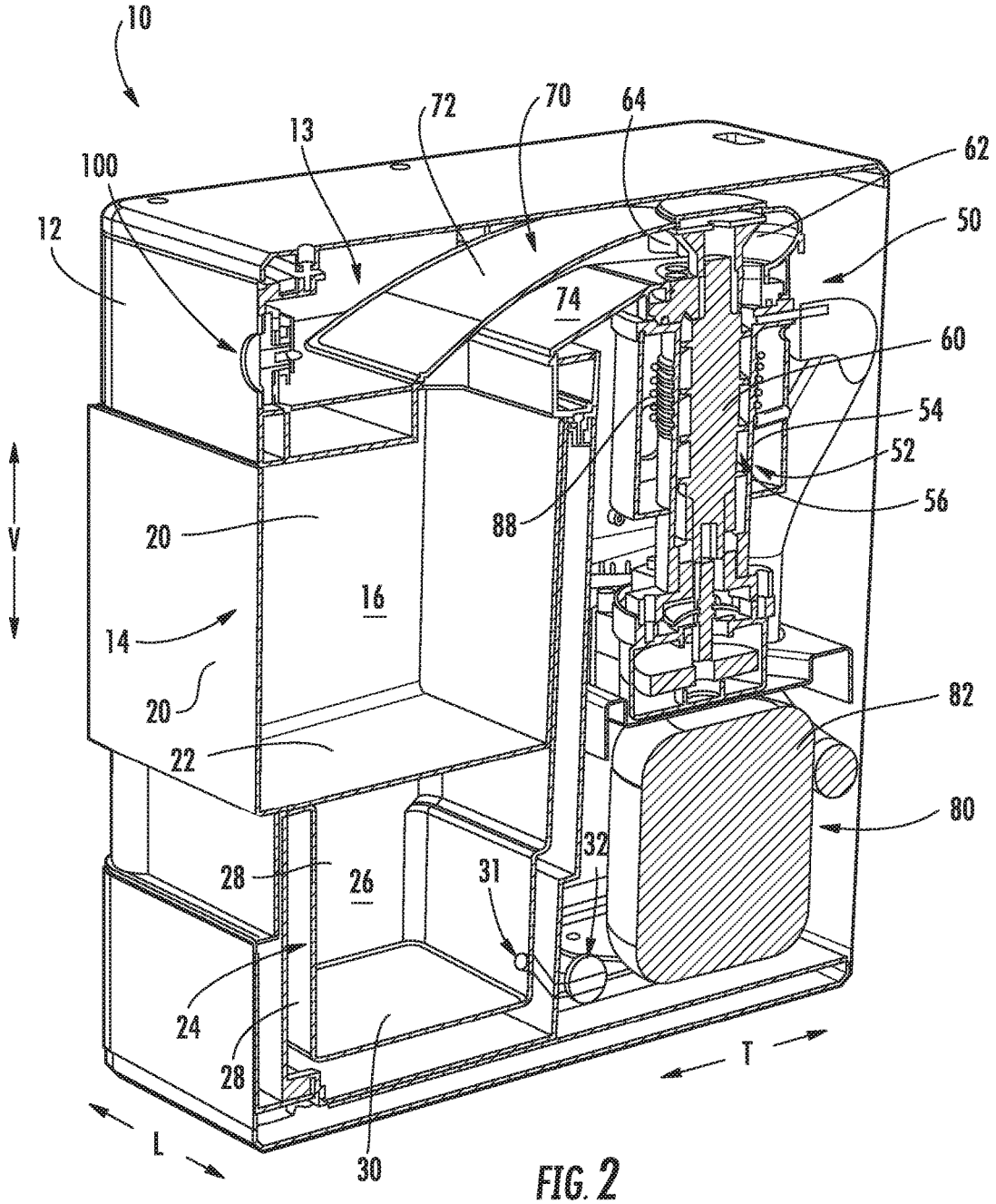
FIG. 2 provides a perspective sectional view of an appliance according to an exemplary embodiment of the present disclosure.

Referring now to FIGS. 1 and 2, one embodiment of an appliance 10 in accordance with the present disclosure is illustrated. As shown, appliance 10 is provided as a stand-alone ice making appliance embodiment. Appliance 10 includes an outer casing 12 which defines an internal volume 13 and generally at least partially houses various other components of the appliance therein 10. Outer casing 12 further defines a vertical direction V, a lateral direction L, and a transverse direction T. The vertical direction V, lateral direction L, and transverse direction T are all mutually perpendicular and form an orthogonal direction system A container 14 of appliance 10 is also illustrated. Container 14 defines a first storage volume 16 for the receipt and storage of ice 18 therein. A user of the appliance 10 may access ice 18 within the container 14 for consumption or other uses. Container 14 may include one or more sidewalls 20 and a base wall 22, which may together define the first storage volume 16. In exemplary embodiments, at least one sidewall 20 may be formed from a clear, see-through (i.e., transparent or translucent) material, such as a clear glass or plastic, such that a user can see into the first storage volume 16 and thus view ice 18 therein. Further, in exemplary embodiments, container 14 may be removable, such as from the outer casing 12, by a user. This facilitates easy access by the user to ice within the container 14 and further, for example, may provide access to a water tank 24 of the appliance 10.

Appliances 10 in accordance with the present disclosure may advantageously be stand-alone appliances, and thus are not connected to refrigerators or other appliances. Additionally, in exemplary embodiments, such appliances are not connected to plumbing or another water source that is external to the appliance 10, such as a refrigerator water source. Rather, in exemplary embodiments, water is initially supplied to the appliance 10 manually by a user, such as by pouring water into water tank 24. Although exemplary appliance 10 is illustrated as a stand-alone ice making appliance embodiment, it is understood that other appliance embodiments may be encompassed by the present disclosure. For example, in other embodiments, the appliance may be provided as coffee maker (i.e., brewer), toaster, blender, etc.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. In exemplary embodiments, such as those shown in FIGS. 1 and 2, the removable container 14 allows easy access to ice and allows the container 14 to be moved to a different position from the remainder of the appliance 10 for ice usage purposes. Additionally, in exemplary embodiments as discussed herein, appliance 10 is configured to make nugget ice (as discussed herein) which is becoming increasingly popular with consumers.

Figure 3:
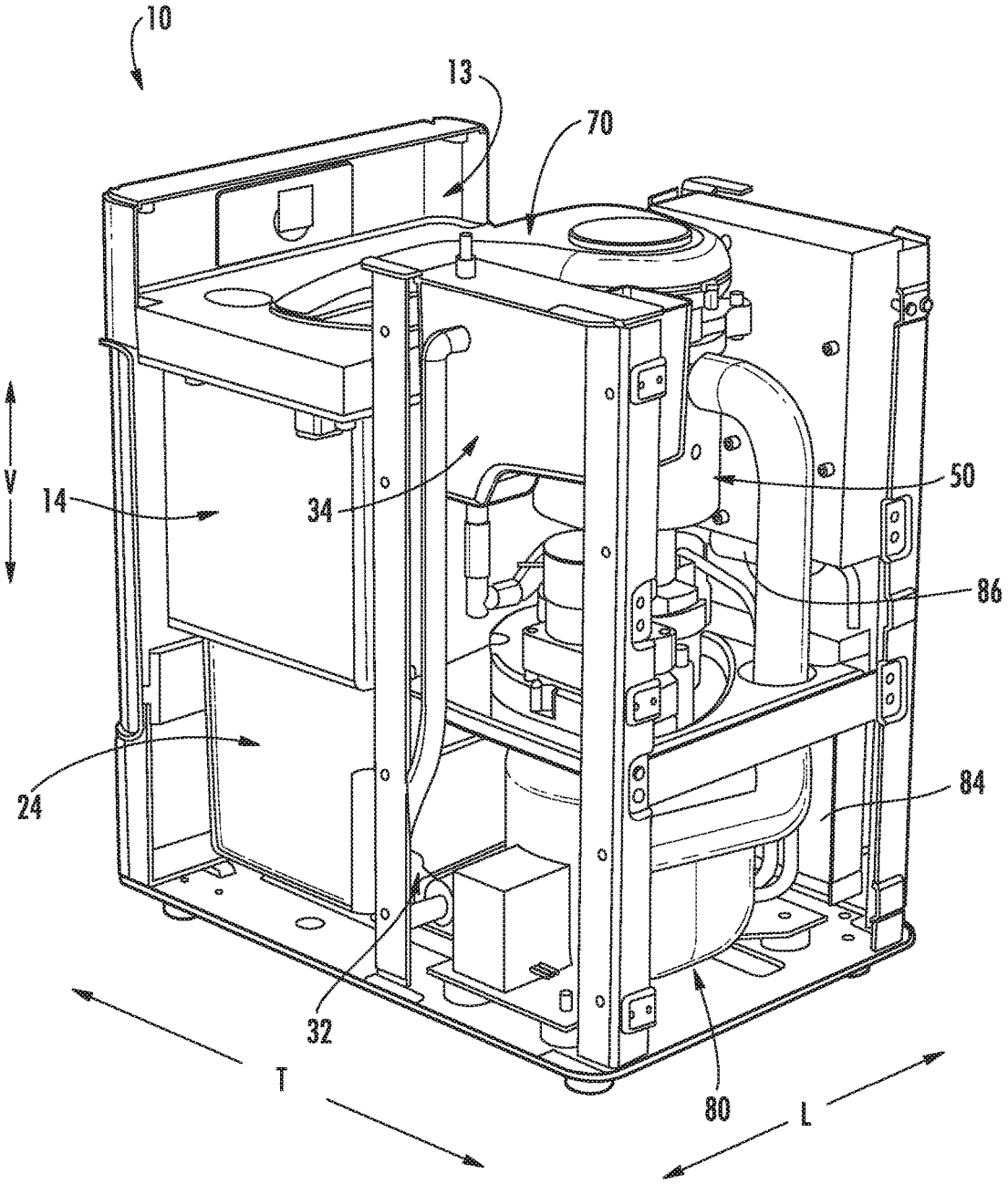
FIG. 3 provides a rear perspective view (with a casing removed) of an appliance according to an exemplary embodiment of the present disclosure.
Figure 4:
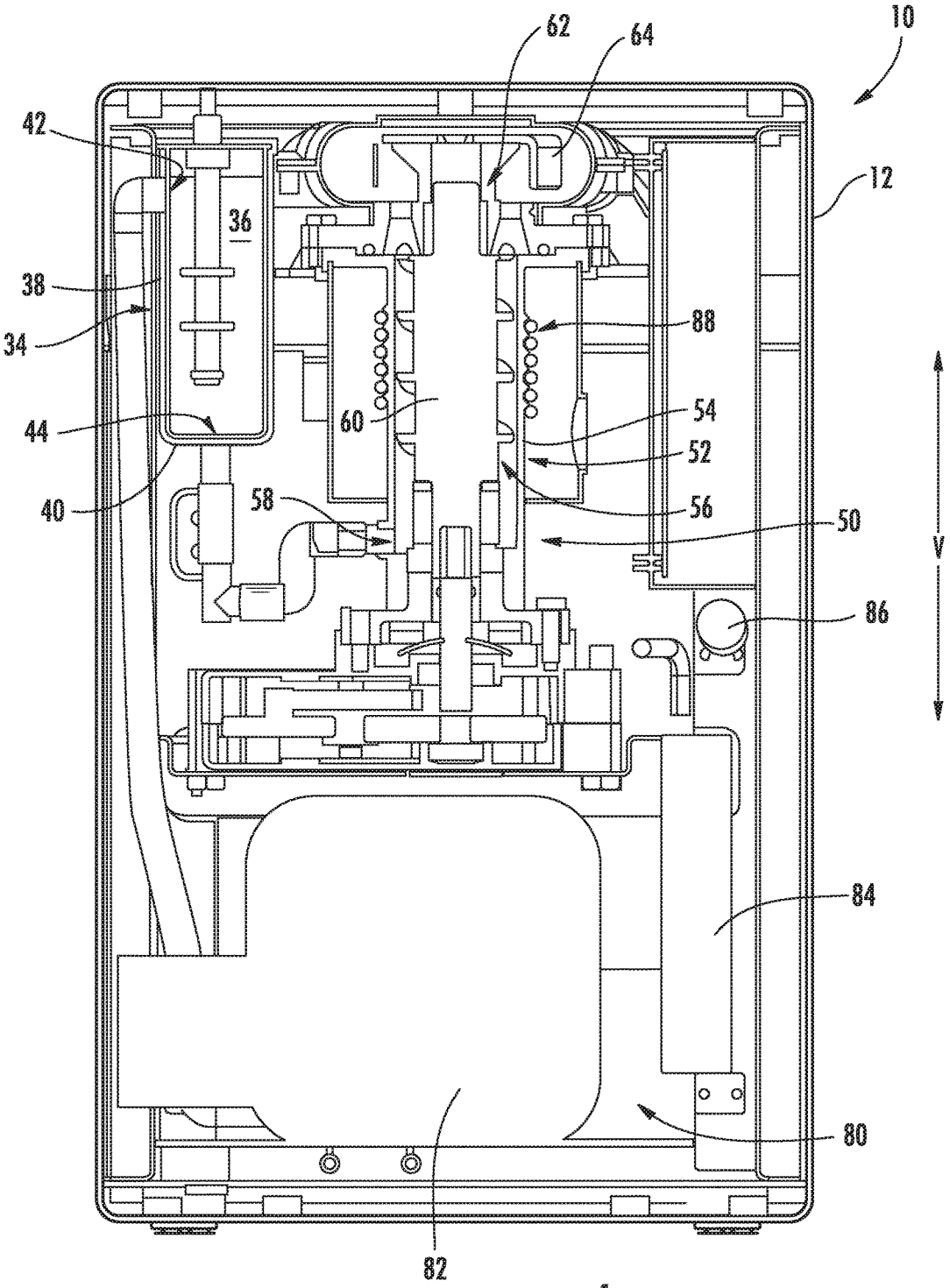
FIG. 4 provides a rear sectional view of an appliance according to an exemplary embodiment of the present disclosure.

Referring to FIGS. 2 through 4, various other components of appliances 10 in accordance with the present disclosure are illustrated. For example, as mentioned, appliance 10 includes a water tank 24. The water tank 24 defines a second storage volume 26 for the receipt and holding of water. Water tank 24 may include one or more sidewalls 28 and a base wall 30 which may together define the second storage volume 26. In exemplary embodiments, the water tank 24 may be disposed below the container 14 along a vertical direction V defined for the appliance 10, as shown.

As discussed, in exemplary embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through an opening 31 defined in the water tank 24, such as in a sidewall 28 thereof, and may flow through a conduit to and through pump 32. Pump 32 may, when activated, actively flow water from the second storage volume 26 therethrough and from the pump 32.

Water actively flowed from the pump 32 may be flowed (e.g., through a suitable conduit) to a reservoir 34. For example, reservoir 34 may define a third storage volume 36, which may be defined by one or more sidewalls 38 and a base wall 40. Third storage volume 36 may, for example, be in fluid communication with the pump 32 and may thus receive water that is actively flowed from the water tank 24, such as through the pump 32. For example, water may be flowed into the third storage volume 36 through an opening 42 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through opening 44 and through suitable conduits, from third storage volume 36 to ice maker 50.

Ice maker 50 generally receives water, such as from reservoir 34, and freezes the water to form ice 18. In exemplary embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening 58 may be defined in a sidewall 54. Water may be flowed from third storage volume 36 through the opening 58 (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in exemplary embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provide to the container 14. In exemplary embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72 which defines a passage 74 therethrough. Ice 18 may be directed from the ice maker 50 (such as from the auger 60 and/or extruder 62) through the passage 74 to the container 14. In some embodiments, for example, a sweep 64, which may for example be connected to and rotate with the auger, may contact the ice emerging through the extruder 62 from the auger 60 and direct the ice 18 through the passage 74 to the container 14.

As discussed, water within the casing 52 may at least partially freeze due to heat exchange, such as with a refrigeration system. In exemplary embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof.

During operation of sealed system 80, refrigerant exits evaporator 88 as a fluid in the form of a superheated vapor and/or vapor mixture. Upon exiting evaporator 88, the refrigerant enters compressor 82 wherein the pressure and temperature of the refrigerant are increased such that the refrigerant becomes a superheated vapor. The superheated vapor from compressor 82 enters condenser 84 wherein energy is transferred therefrom and condenses into a saturated liquid and/or liquid vapor mixture. This fluid exits condenser 84 and travels through throttling device 86 that is configured for regulating a flow rate of refrigerant therethrough. Upon exiting throttling device 86, the pressure and temperature of the refrigerant drop at which time the refrigerant enters evaporator 88 and the cycle repeats itself. In certain exemplary embodiments, throttling device 86 may be a capillary tube. Notably, in some embodiments, sealed system 80 may additionally include fans (not shown) for facilitating heat transfer to/from the condenser 84 and evaporator 88.

As discussed, in exemplary embodiments, ice 18 may be nugget ice. Nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Turning to FIGS. 5 through 11, a user interface 100 is provided with outer casing 12 to facilitate communication between appliance 10 (see FIG. 1) and a user. User interface 100 is mounted to outer casing 12 and generally includes a light projector 102 positioned within internal volume 13. As shown, a translucent diffuser disc 106 is positioned between light projector 102 and outer casing 12, while a user input selector 104 is disposed on light projector 102 proximate to diffuser disc 106.

Generally, light projector 102 is configured to transmit one or more light emissions 108 through diffuser disc 106 and outside of internal volume 13 to the ambient environment surrounding appliance 10. In turn, light emissions 108 may be at least partially visible through outer casing 12. In some embodiments, a plurality of discrete segmented light emitting diodes (LEDs) 112 is provided at light projector 102. Each LED 112 is spaced apart from the others and directed toward outer casing 12. During use, one or more discrete light emissions 108 may be selectively emitted by each LED 112. Optionally, one or more of the LEDs 112 may be provided as a multi-color diode. For instance, each multi-color diode may include distinct red, green, and blue elements to selectively vary the visible color of light emissions 108 projected from LED 112. In additional or alternative embodiments, one or more of the LEDs 112 may be configured to emit light emissions 108 of only a single visible color.

In some embodiments, the plurality of LEDs 112 is positioned within internal volume 13 at a uniform distance from a portion, e.g., a wall, of outer casing 12. Moreover, each LED 112 may be positioned at a uniform distance from each other, i.e., in relation to each adjacent LED 112. When assembled, each LED 112 is directed toward diffuser disc 106 and, optionally, a wall of outer casing 12. In certain exemplary embodiments, LEDs 112 are arranged as an annular ring. Moreover, the annular ring may be shaped to have a substantially circular footprint in relation to the wall that it faces.

As shown, a slot 114 is defined in outer casing 12. Slot 114 has a preformed shape and extends from an exterior surface 116 of outer casing 12 to an interior surface 118 of outer casing 12. Slot 114 may be matched to the light projector 102 and include a shape that corresponds to that of the assembled plurality of LEDs 112. For instance, in exemplary embodiments wherein plurality of LEDs 112 are arranged as an annular ring (e.g., FIG. 5), slot 114 may be similarly defined to include a similar annular shape along a circumferential direction C. In turn, light projector 102 may be aligned at an offset, e.g., coaxial, position from slot 114. Light projector 102 defines a maximum diameter that is greater than a coaxial maximum diameter that is defined by slot 114.

Figure 5:
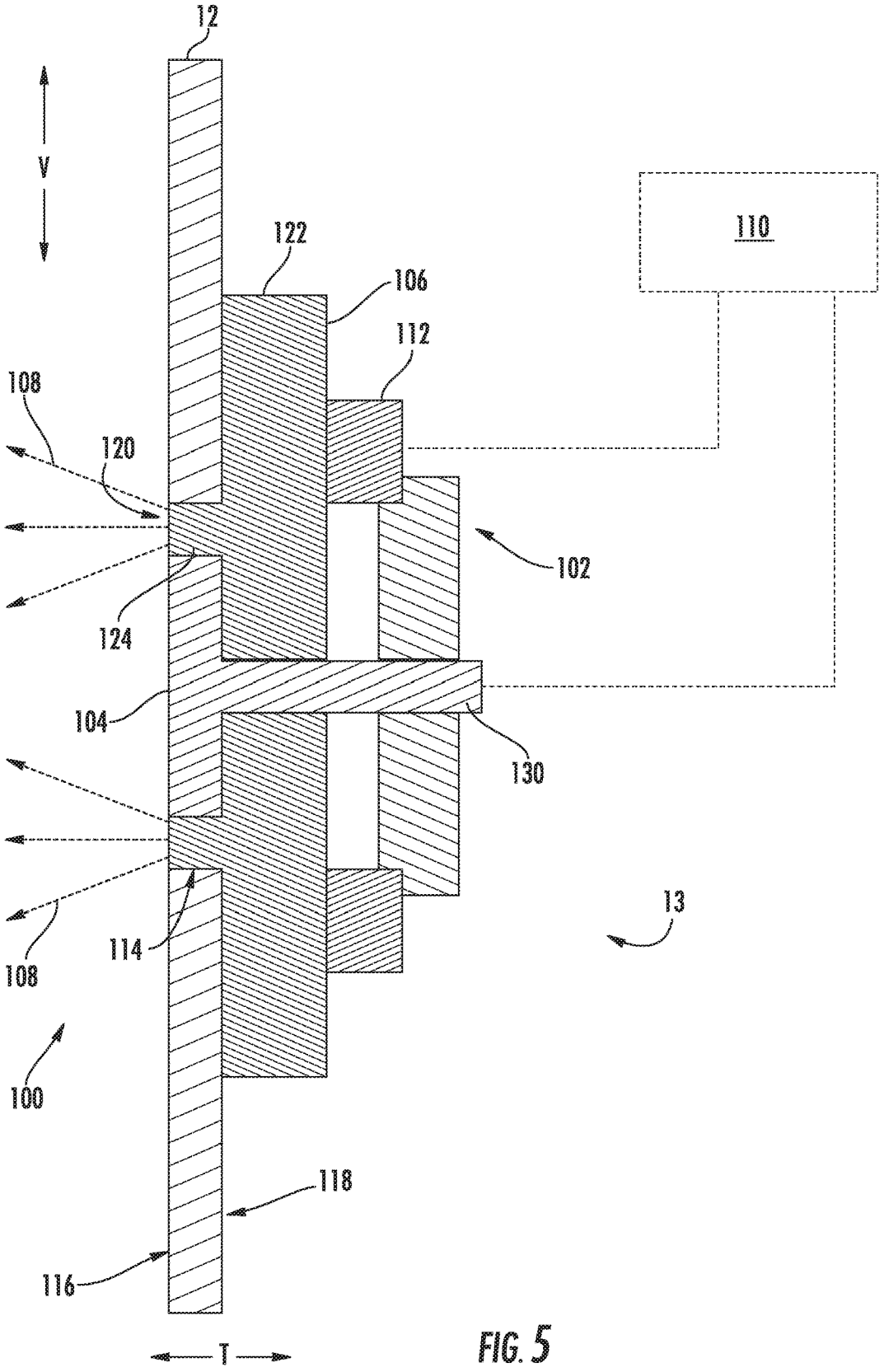
FIG. 5 provides a side sectional view of a user interface of an appliance according to an exemplary embodiment of the present disclosure.
Figure 6:
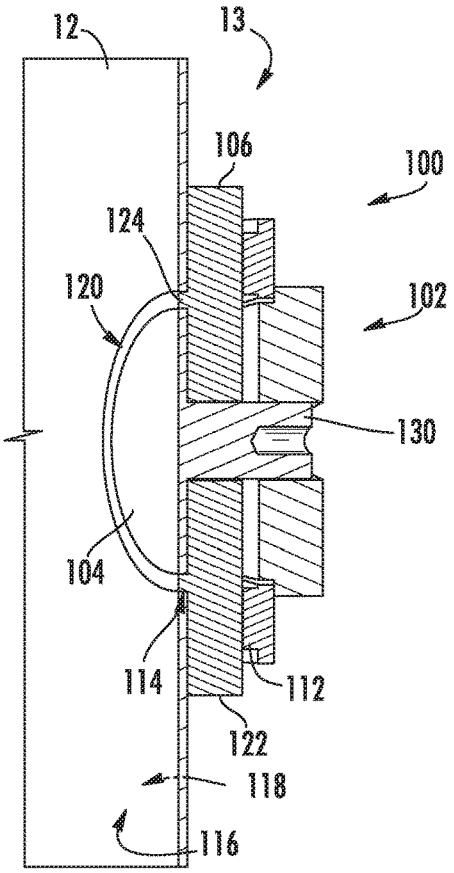
FIG. 6 provides a front perspective sectional view of the exemplary user interface embodiment of FIG. 5.
Figure 7:
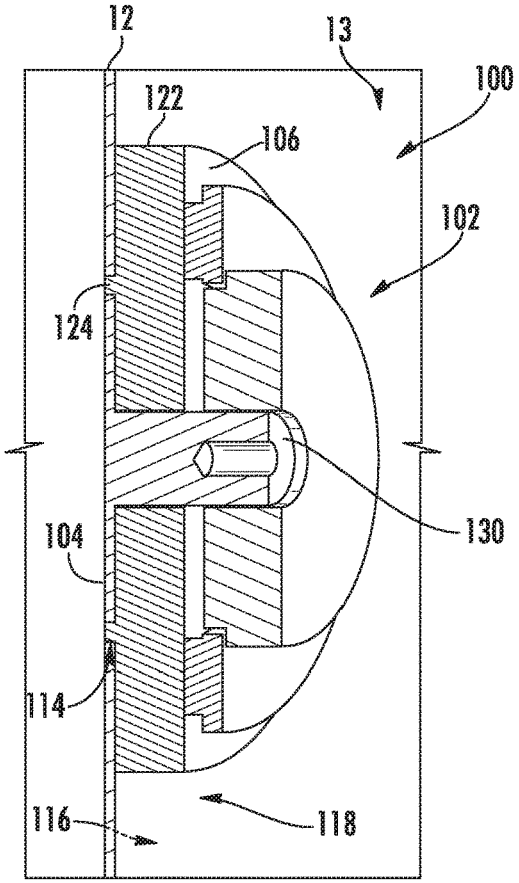
FIG. 7 provides a rear perspective sectional view of the exemplary user interface embodiment of FIG. 5.

In exemplary embodiments, such as the embodiment shown in FIG. 5, light projector 102 is aimed directly toward interior surface 118 of outer casing 12, and not slot 114. Light emissions 108 from LEDs 114 will be dispersed through diffuser disc 108 before being directed through slot 114.

Diffuser disc 106 is disposed in a fixed relative position between outer casing 12 and light projector 102. An uninterrupted or continuous outer surface 120 extends from a base 122. When assembled, continuous outer surface 120 is positioned outward, e.g., in the transverse direction T, away from internal volume 13 while base 122 is positioned inward and proximate light projector 102. Moreover, continuous outer surface 120 may be the surface of diffuser disc 106 furthest from internal volume 13 that is visible from outside outer casing 12. In some embodiments, diffuser disc 106 extends at least partially through outer casing 12. For example, an unsegmented groove 124 extends from base 122 and through slot 114 to define continuous outer surface 120. Optionally, continuous outer surface 120 is positioned flush with outer casing 12, e.g., along exterior surface 116. When assembled, continuous outer surface 120 is visible from outside of outer casing 12, and thus includes visible maximums and minimums, such as a top apex 126 defined at a vertical maximum and a bottom apex 128 defined at a vertical minimum.

Base 122 is positioned behind outer casing 12, e.g., behind interior surface 118. In some embodiments, base 122 engages interior surface 118 to rest thereon. When assembled, base 122 is configured to receive and direct light emissions 108 from light projector 102 before some of light emissions 108 are emitted from continuous outer surface 120. In turn, continuous outer surface 120 is defined on diffuser disc 106 such that continuous outer surface 120 is aligned with light projector 102. During use, continuous outer surface 120 displays light emissions 108 to users, e.g., as a visually continuous pattern 132. Optionally, base 122 extends across LEDs 112 to fully receive any light emissions 108 therefrom. Although at least a portion of light emissions 108 may exit diffuser disc 106 at continuous outer surface 120, another portion may leak from a side or outer portion of base 122 within internal volume 13.

In some embodiments, diffuser disc 106 may be formed from a uniform translucent material, such as a cast white acrylic or polycarbonate. Additionally or alternatively, a translucent coating or film may be applied to diffuser disc 106, e.g., at continuous outer surface 120 or base 122. The thickness of the diffuser disc 106, e.g., in the transverse direction T, may be tuned to the intensity and/or positioning of LEDs 112. In turn, light emissions 108 are visible at continuous outer surface 120, while being substantially dispersed and intermixed to prevent individual LEDs 112 from being separately identifiable at continuous outer surface 120.

As shown, user input selector 104 is positioned proximate to diffuser disc 106, and specifically, continuous outer surface 120. User input selector 104 may be configured to receive one or more user input related to operation of appliance 10 (see FIG. 1). In turn, user input selector 104 may be configured as a physical engagement member, such as a toggle, button, touch panel, wheel, and/or other suitable input mechanism. For instance, in certain exemplary embodiments, user input selector 104 includes a circular button positioned proximate to the diffuser disc 106. In the illustrated embodiments of FIGS. 5 through 11, button 104 is defined along the coaxial direction C, and may be positioned coaxial within the annular array of LEDs 112. Optionally, button 104 is also positioned coaxial within continuous outer surface 120 and slot 114.

Button 104 may be formed as a capacitive touch panel, suitable for detecting variations in capacitance thereon, e.g., as caused by contact with a user's skin. Optionally, button 104 may be positioned or mounted to be substantially flush with one or more outer surface. For instance, button 104, including capacitive touch panel may be flush with continuous outer surface 120 of diffuser disc 106, e.g., along the lateral direction L and vertical direction V. Additionally or alternatively, button 104, including capacitive touch panel, may be flush with exterior surface 116 of outer casing 12. In some embodiments, a conductive frame 130 extends into internal volume 13 from outer casing 12 to operably connect capacitive touch panel of button 104 to another portion of the appliance, e.g., a controller 110. Optionally, a spacer member may be positioned over conductive frame and hold LEDs 112 at a predetermined distance from conductive frame.

As shown, a controller 110 is operably connected to user input selector 104 and light projector 102. Controller 110 may be configured to control one or more operations of appliance 10 (see FIG. 1). For example, controller 110 may be configured to initiate functional operations of an appliance based on user input or engagement with user input selector 104 and/or inputs from various sensors disposed within an appliance. In some embodiments, controller 110 includes one or more memory devices and one or more microprocessors, such as general or special purpose microprocessors operable to execute programming instructions or micro-control code associated with operations of appliance 10. The memory may represent random access memory such as DRAM, or read only memory such as ROM or FLASH. In one embodiment, the processor executes programming instructions stored in memory. The memory may be a separate component from the processor or may be included onboard within the processor.

In exemplary embodiments, controller 110 is configured to determine or dictate the operation of light projector 102. For instance, controller 110 may determine a visually continuous pattern 132 displayed at continuous outer surface 120. Controller 110 may initiate select or stored visually continuous patterns 132 based, at least partially, on a condition of appliance 10 (see FIG. 2). In some such embodiments, controller 110 is configured to receive a condition signal from another portion of the appliance. Optionally, a condition signal may be transmitted to controller 110 from user input selector 104. The transmission may be contingent upon user engagement or input at user input selector 104. A condition signal may additionally or alternatively be transmitted to controller 110 from one or more sensors detecting various settings or states within the appliance 10 (see FIG. 1). For example, one sensor may detect that ice is being made at icemaker 50 (see FIG. 2), that a storage volume 16, 26, 36 (see FIGS. 2 through 4) is empty or full, that user input selector 104 has been engaged, or another relevant condition.

In some embodiments, controller 110 selectively initiates a visually continuous pattern 132. Optionally, initiation of the visually continuous pattern 132 is tied to a condition signal. Controller 110 may selectively initiate a certain visually continuous pattern 132 according to the received condition signal. In turn, the visually continuous pattern 132 initiated by controller 110 may be selected from a plurality of discrete visually continuous patterns 132 provided or stored within controller 110.

Figure 8:
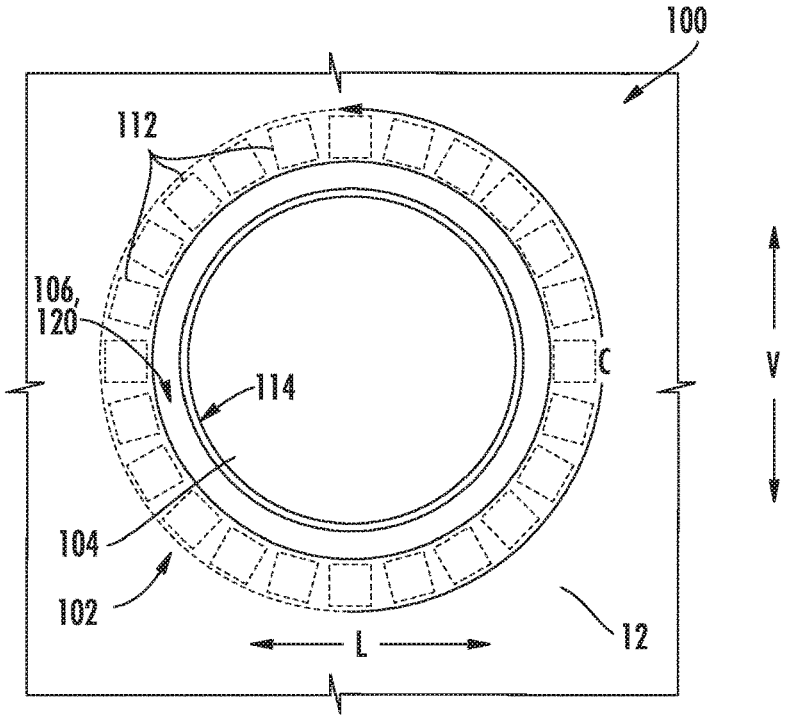
FIG. 8 provides a transparent front view of the exemplary user interface embodiment of FIG. 5.
Figure 9:
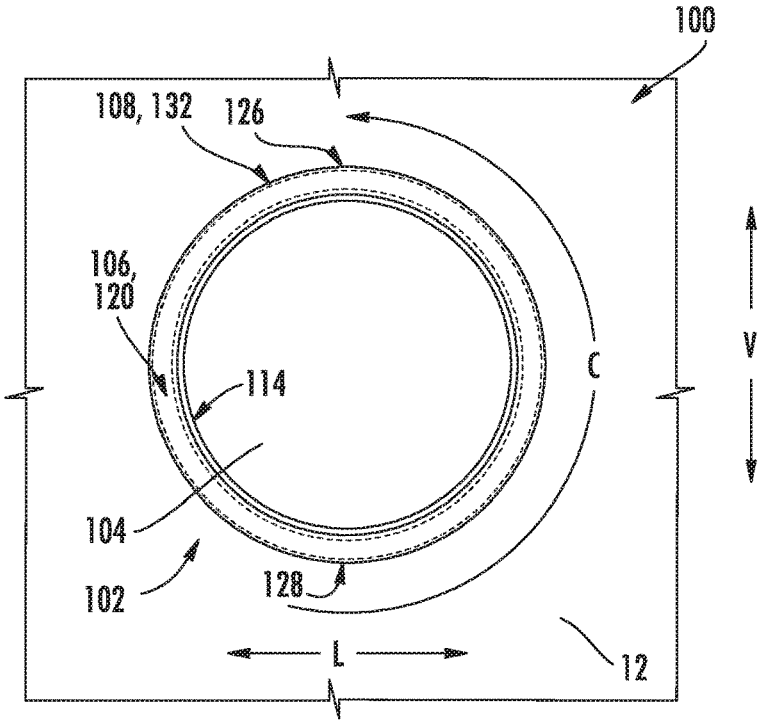
FIG. 9 provides a front view of the exemplary user interface embodiment of FIG. 5, wherein the user interface is initiating an exemplary visually continuous pattern.

Turning to FIGS. 8 through 111, several exemplary visually continuous patterns 132 of light emissions 108 are illustrated. In exemplary embodiments, including embodiments similar to FIG. 8, controller 110 (see FIG. 5) includes a stored visually continuous pattern 132 embodied by a single color of light emissions 108 displayed at continuous outer surface 120. Some or all of LEDs 112 may simultaneously emit a light emission 108 of the same visible color wavelength. In additional or alternative exemplary embodiments, controller 110 (see FIG. 5) includes a stored animation program of a repetitive pulse of light emissions 108 displayed at continuous outer surface 120. The pulse may be a generally synchronized or sequenced at a set time pattern, as well as a visual pattern of the light emissions 108 when activated, e.g., a single color to be flashed at a predetermined rate. Such patterns or pulses may be initiated in response to controller 110 (see FIG. 5) determining a monitored condition within one portion of appliance 10 (see FIG. 1), e.g., that user input selector 104 or appliance 10 is temporarily unable to receive user input, that first storage volume 16 (see FIG. 1) is full that user input selector 104 has been engaged, etc.

Figure 10:
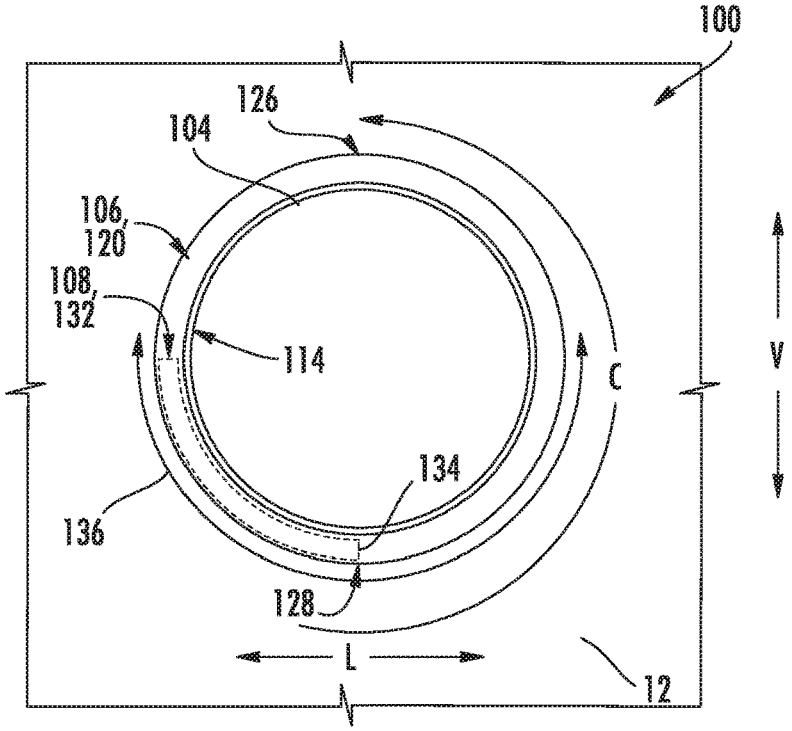
FIG. 10 provides a front view of the exemplary user interface embodiment of FIG. 5, wherein the user interface is initiating another exemplary visually continuous pattern.
Figure 11:
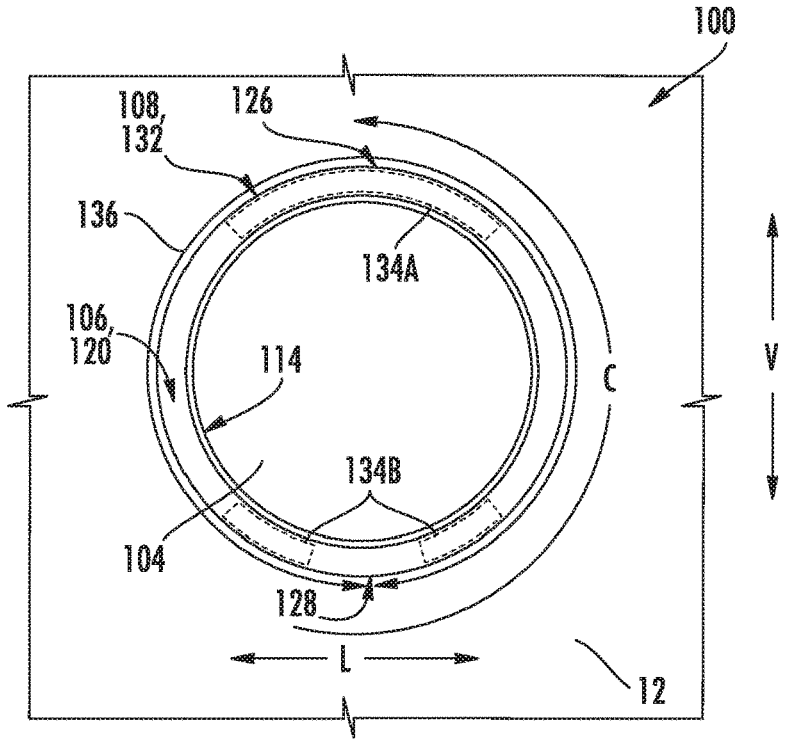
FIG. 11 provides a front view of the exemplary user interface embodiment of FIG. 5, wherein the user interface is initiating yet another exemplary visually continuous pattern.

In further additional or alternative exemplary embodiments, such as those illustrated in FIG. 10, controller 110 (see FIG. 5) includes a stored visually continuous pattern 132 embodied by a single uninterrupted band 134 of light emissions 108. As shown, uninterrupted band 134 is displayed at continuous outer surface 120. Although band 134 is formed from light emissions 108 generated at multiple discrete LEDs 112 (see FIG. 8), band 134 extends unbroken across a portion (i.e., less than the entirety) of continuous outer surface 120 (e.g., as a semi-circular arc). Of the active LEDs 112 emitting light emissions 108, all may simultaneously emit a light emission 108 of the same visible color wavelength, e.g., blue. Optionally, controller 110 (see FIG. 5) is configured to animate band 134, e.g., according to a stored animation program illustrated at arrow 136. In such embodiments, a single uninterrupted band 134 may be animated across continuous outer surface 120. For example, uninterrupted band 134 may be animated rotate as a constant-length band across the entirety of outer surface 120. As an additional or alternative example, uninterrupted band 134 may be animated to expand or grow uninterrupted across a predetermined portion of outer surface 120, e.g., a radial segment of a circular continuous outer surface 120. As a further additional or alternative example, uninterrupted band 134 may be animated to oscillate, similar to a pendulum or sloshed water. Uninterrupted band 134 may be oscillated in alternating clockwise and counter-clockwise sweeps. Each sweep may be reversed before reaching the top apex 126 of the continuous outer surface 120. Such oscillations may be initiated in response to controller 110 (see FIG. 5) determining a monitored condition within one portion of appliance, e.g., a low level of water within one storage volume 16, 26, 36 (see FIGS. 2 through 4).

In still further additional or alternative embodiments, such as those illustrated in FIG. 10, controller 110 (see FIG. 5) includes a stored visually continuous pattern 132 embodied by a multiple uninterrupted bands 134A, 134B of light emissions 108. As shown, multiple uninterrupted bands 134A, 134B may include a converging pair of uninterrupted bands 134B displayed at continuous outer surface 120. Although bands 134A, 134B are formed from light emissions 108 generated at multiple discrete LEDs 112 (see FIG. 8), each band 134B extends across a portion of continuous outer surface 120, e.g., as a semi-circular arc. Of the active LEDs 112 emitting light emissions 108, all may simultaneously emit a light emission 108 of the same visible color wavelength, e.g., white. Optionally, controller 110 (see FIG. 5) is configured to animate each band 134A, 134B, e.g., according to a stored animation program illustrated at arrow 136. In such embodiments, multiple bands 134A, 134B may be displayed across continuous outer surface 120. For example, a single uninterrupted band 134A may be animated to grow from an initial point or LED 112 to diverge as an opposing pair of two bands 134B, the opposing pair of bands 134B being animated to converge and dissolve into another point or LED 112, simulating falling ice. Two bands 134B may, thus, simultaneously emerge in opposite radial directions from top apex 126 and dissolve at bottom apex 128. Such animations may be initiated in response to controller 110 (see FIG. 5) determining a monitored condition within one portion of the appliance, e.g., ice maker 50 (see FIG. 2) has been activated and an ice making operation is taking place.

Figure 12:
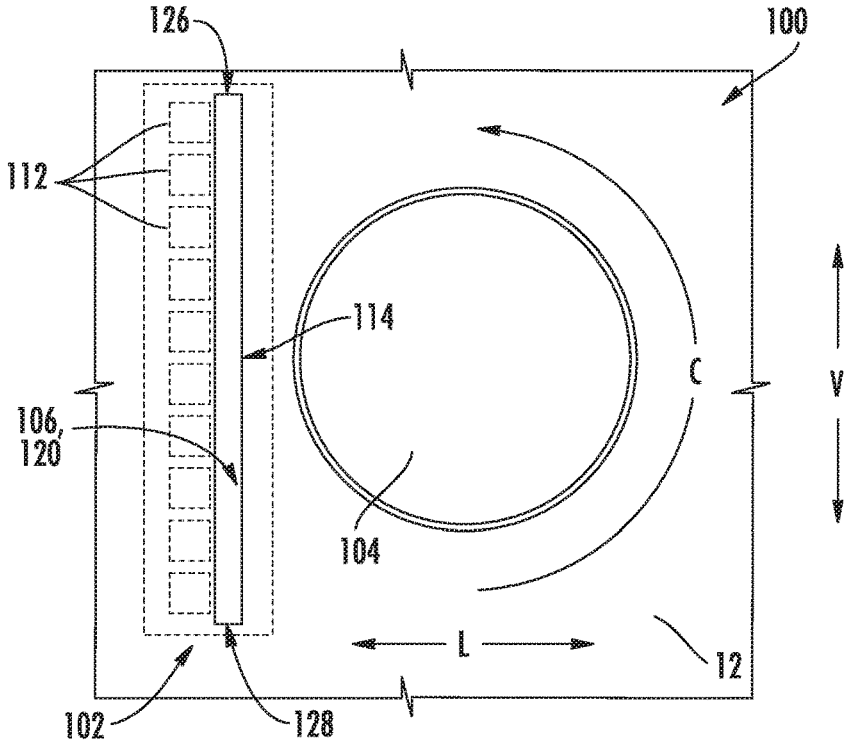
FIG. 12 provides a transparent front view of another exemplary user interface embodiment.
Figure 13:
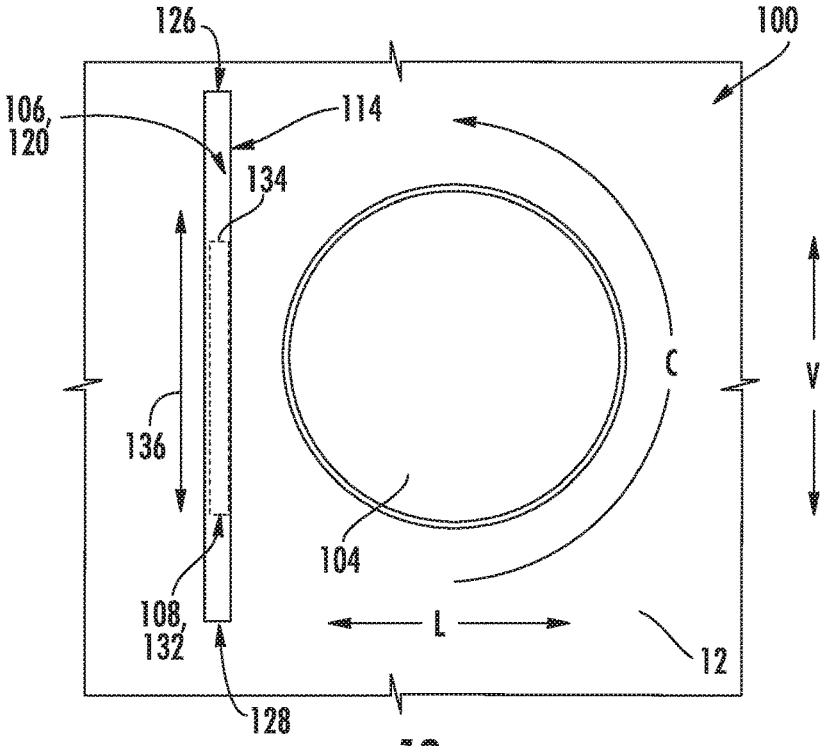
FIG. 13 provides a front view of the exemplary user interface embodiment of FIG. 12, wherein the user interface is initiating an exemplary visually continuous pattern.

Although the embodiments of FIGS. 5 through 11 illustrate the light projector 102 as an annular array, and the diffuser disc 106 as a matched circular ring, it is understood that another suitable shape may be provided without departing from the present disclosure. As shown in FIGS. 12 and 13, exemplary alternative embodiments of user interface 100 may be provided. Except as otherwise indicated, it is understood that the embodiments of FIGS. 12 and 13 are substantially identical to those of FIGS. 5 through 11. For example, LEDs 112 are arranged as a non-annular linear array, e.g., aligned along the vertical direction V. Diffuser disc 106 and slot 114 are matched to define a linear continuous outer surface 120 through outer casing 12. User input selector 104 is illustrated as a button positioned adjacent to the linear array of LEDs 112, continuous outer surface 120, and slot 114.

As described above, one or more visually continuous pattern 132 is selectively initiated by controller 110 and displayed at continuous outer surface 120. Visually continuous pattern(s) 132 may, thus, include a single color of light emissions 108, a pulse of light emissions 108, one or more uninterrupted bands 134 animated across continuous outer surface 120, or another suitable pattern, e.g., according to a stored animation program illustrated at arrow 136.

Figure 14:
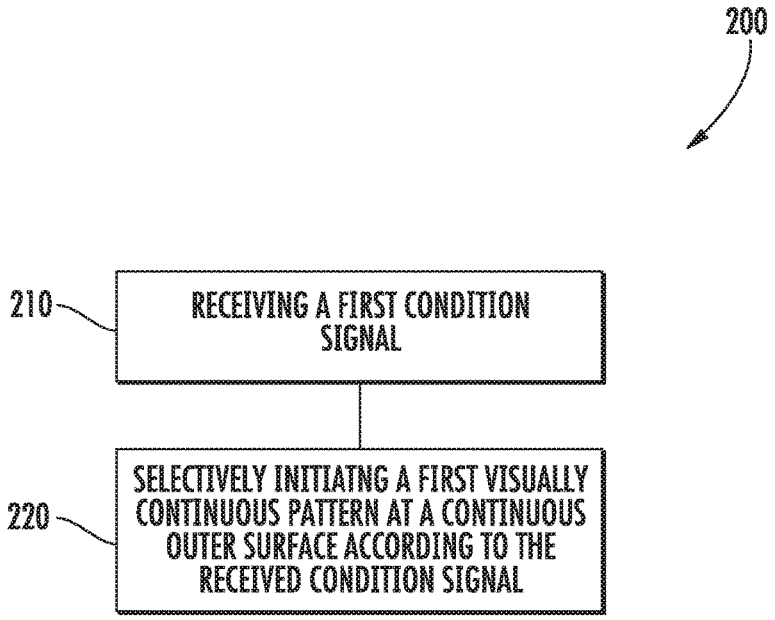
FIG. 14 provides a flow chart illustrating a method of controlling a user interface for an appliance in accordance with an exemplary embodiment of the present disclosure.

Turning now to FIG. 14, a flow diagram is provided of a method 200 according to an exemplary embodiment of the present disclosure. Generally, the method 200 provides for controlling user interface 100 in an appliance 10 (see FIG. 1) that includes a light projector 102 and diffuser disc 106, as described above. The method 200 can be performed, for instance, by the controller 110. For example, controller 110 may, as discussed, be in communication with light projector 102 and user input selector 104, and may send signals to and receive signals from light projector 102 and user input selector 104. Controller 110 may further be in communication with other suitable components of the appliance to facilitate operation of the appliance 10 (see FIG. 1) generally. FIG. 14 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Referring to FIG. 14, at 210, the method 200 includes receiving a first condition signal. The received condition signal may be transmitted from a user input selector, a sensor disposed within the appliance, a discrete component (e.g., icemaker) within the appliance, or within the controller.

Upon a signal being received, a determination may be made that a certain condition of the appliance has been reached, e.g., that a predetermined operation has been initiated, that appliance is temporarily unable to receive user input, that a storage volume is in need of water, that icemaker is producing ice, etc. Optionally, a sensor disposed within a storage volume may monitor the water level within the storage volume. Upon water within the storage volume reaches a predetermined level, the sensor may transmit a signal to the controller. The controller may receive the transmitted signal and determine that a certain condition has been met. Additionally or alternative, upon an ice making function being selected and/or initiated, a condition signal may be transmitted by, and received within, the controller.

At 220, the method 200 includes selectively initiating a first visually continuous pattern at the continuous outer surface according to the received condition signal. For instance, the visually continuous pattern may be initiated based on a condition determined upon receiving a condition signal. In some embodiments, 220 includes displaying a single color of light emissions at the continuous outer surface, e.g., by initiating light emissions from a light projector. In additional or alternative embodiments, 220 includes displaying an uninterrupted band of light emissions at the continuous outer surface, and animating the uninterrupted band across the continuous outer surface. As described above, animating the uninterrupted band may include oscillating the uninterrupted band in alternating clockwise and counter-clockwise sweeps between a top apex of the continuous outer surface and a bottom apex of the continuous outer surface. Each sweep may be reversed before reaching a top apex of the continuous outer surface. Animating the uninterrupted band may also or alternatively include generating two diverging bands that simultaneously emerge in opposite radial directions from a top apex of the continuous outer surface and dissolve at the bottom apex of the continuous outer surface.

Once 210 and 220 have occurred, method 200 may further include receiving an additional (e.g., second) condition signal, and initiating an additional (e.g., second) visually continuous pattern. Optionally, multiple further additional condition signals and visually continuous patterns may be provided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

an outer casing defining an enclosed volume;

a user interface mounted to the outer casing, the user interface comprising a light projector positioned within the enclosed volume, the light projector including a plurality of discrete segmented light emitting diodes to each selectively emit one or more discrete light emissions, and a translucent diffuser disc positioned between the light projector and the outer casing, the diffuser disc including a continuous outer surface aligned with the light projector to display the one or more discrete light emissions as a visually continuous pattern; and a controller operably connected with the light projector, the controller being configured to determine the visually continuous pattern displayed at the continuous outer surface, wherein outer casing further defines a slot aligned with the light projector, wherein the outer casing further defines a slot having a maximum diameter aligned with the light projector, and wherein the diffuser disc further includes a base positioned behind the outer casing and across the plurality of light emitting diodes, the base having a maximum diameter greater than the maximum diameter of the slot, and an unsegmented groove extending from the base and through the slot to define the continuous outer surface.

2. The appliance of claim 1, wherein the plurality of light emitting diodes are arranged as a ring in an annular array.

3. The appliance of claim 2, further comprising:

a user input selector including a button coaxially positioned within the annular array of light emitting diodes.

4. The appliance of claim 3, wherein the button includes a capacitive touch panel.

5. The appliance of claim 1, wherein the controller is further configured to:

receive a condition signal, and selectively initiate a visually continuous pattern according to the received condition signal.

6. The appliance of claim 5, wherein initiating a visually continuous pattern includes displaying a single color of light emissions at the continuous outer surface.

7. The appliance of claim 5, wherein initiating a visually continuous pattern includes displaying a repetitive pulse of light emissions at the continuous outer surface.

8. The appliance of claim 5, wherein the continuous outer surface of the diffuser disc includes a top apex defined at a vertical maximum and a bottom apex defined at a vertical minimum, and wherein initiating a visually continuous pattern includes displaying an uninterrupted band of light emissions at the continuous outer surface, and animating the uninterrupted band along the continuous outer surface.

9. The appliance of claim 8, wherein animating the uninterrupted band includes oscillating the uninterrupted band in alternating clockwise and counter-clockwise sweeps, and wherein each sweep is reversed before reaching the top apex of the continuous outer surface.

10. The appliance of claim 8, wherein animating the uninterrupted band includes generating two diverging bands that simultaneously emerge in opposite radial directions from the top apex and dissolve at the bottom apex.

11. The appliance of claim 1, wherein each of the plurality of light emitting diodes includes a multi-color diode to selectively vary a visible color of light emissions therefrom.

12. A method of controlling a user interface for an appliance, the user interface including a light projector including a plurality of discrete segmented light emitting diodes, the user interface further including a diffuser disc having a continuous outer surface, the diffuser disc being positioned between the light projector and an outer casing of the appliance, the method comprising:

receiving a first condition signal, and selectively initiating a first visually continuous pattern at the continuous outer surface according to the received condition signal, wherein the outer casing defines a slot having a maximum diameter aligned with the light projector, and wherein the diffuser disc further includes a base positioned behind the outer casing and across the plurality of light emitting diodes, the base having a maximum diameter greater than the maximum diameter of the slot, and an unsegmented groove extending from the base and through the slot to define the continuous outer surface.

13. The method of claim 12, wherein initiating a first visually continuous pattern includes displaying a single color of light emissions at the continuous outer surface.

14. The method of claim 12, wherein initiating a first visually continuous pattern includes displaying a repetitive pulse of light emissions at the continuous outer surface.

15. The method of claim 12, wherein initiating a first visually continuous pattern includes displaying an uninterrupted band of light emissions at the continuous outer surface, and animating the uninterrupted band across the continuous outer surface.

16. The method of claim 15, wherein animating the uninterrupted band includes oscillating the uninterrupted band in alternating clockwise and counter-clockwise sweeps between a top apex of the continuous outer surface and a bottom apex of the continuous outer surface, and wherein each sweep is reversed before reaching a top apex of the continuous outer surface.

17. The method of claim 15, wherein animating the uninterrupted band includes generating two diverging bands that simultaneously emerge in opposite radial directions from a top apex of the continuous outer surface and dissolve at the bottom apex of the continuous outer surface.

18. The method of claim 12, further comprising:

receiving a second condition signal from the appliance; and selectively initiating a second visually continuous pattern at the continuous outer surface according to the second received condition signal, the second visually continuous pattern being distinct from the first visually continuous pattern.

* * * * *